US009675894B2

(12) United States Patent
Vatcher et al.

(10) Patent No.: US 9,675,894 B2
(45) Date of Patent: Jun. 13, 2017

(54) AMUSEMENT PARK ELEVATOR DROP RIDE SYSTEM AND ASSOCIATED METHODS

(71) Applicant: Dynamic Motion Group, GmbH, Vienna (AT)

(72) Inventors: David J. Vatcher, Longwood, FL (US); Simon A. James, Merthyr Tydfil (GB); Andrew J. Cox, Tintinhull Yeovil (GB)

(73) Assignee: Dynamic Motion Group GMBH, Vienna (AT)

( * ) Notice: Subject to any disclaimer, the term of this patent is extended or adjusted under 35 U.S.C. 154(b) by 0 days.

(21) Appl. No.: 14/970,697

(22) Filed: Dec. 16, 2015

(65) Prior Publication Data

US 2016/0175720 A1 Jun. 23, 2016

Related U.S. Application Data

(63) Continuation of application No. 14/156,975, filed on Jan. 16, 2014, now Pat. No. 9,242,181, which is a (Continued)

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
CPC ..... A63G 31/00; A63G 31/02; A63G 31/10; A63G 31/16; A63G 2032/002; G09B 9/00; G09B 9/08; G09B 9/12
(Continued)

(56) References Cited

U.S. PATENT DOCUMENTS 2,229,201 A 1/1941 Williford et al.
3,304,628 A 2/1967 Kaplan
(Continued)

FOREIGN PATENT DOCUMENTS

WO 2011064560 A1 6/2011

OTHER PUBLICATIONS

International Search Report of Aug. 29, 2014 for International Application No. PCT/US14/33364.

*Primary Examiner* — Kien Nguyen
(74) *Attorney, Agent, or Firm* — Carl M. Napolitano; GrayRobinson, P.A.

(57) ABSTRACT

A cable driven elevator system having an elevator platform with an integral motion system is provided using one or multiple actuators. Each actuator includes a support plate attached to the elevator platform, a planetary gearbox engaged with and driven by an electric servo motor, and a drive shaft driven by the servo motor and engaged with a one crank. Connecting rods are connected between the crank and a frame. The frame supports a passenger platform. A control system is operable with each electric servo motor of each actuator for providing a simulated motion to the passenger platform including a heaving (vertical) motion such that the vertical downward acceleration experienced by persons riding the elevator exceeds 1 g, by way of example. The motion system is also capable of directly imparting vibrations to the elevator platform of up to at least 100 Hz without additional vibration generating equipment.

7 Claims, 6 Drawing Sheets

Related U.S. Application Data continuation-in-part of application No. 14/094,883, filed on Dec. 3, 2013, now Pat. No. 9,259,657.

(60) Provisional application No. 61/753,013, filed on Jan. 16, 2013, provisional application No. 61/732,534, filed on Dec. 3, 2012.

(58) Field of Classification Search
USPC ..... 472/2, 59, 60, 61, 130, 131, 137; 434/29, 55
See application file for complete search history.

(56) References Cited

U.S. PATENT DOCUMENTS

| | | | |
|---|---|---|---|
| RE27,051 | E | 2/1971 | Cappel |
| 3,559,936 | A | 2/1971 | Guyon |
| 3,577,659 | A | 5/1971 | Kail |
| 3,967,387 | A | 7/1976 | Marchegiani |
| 4,343,610 | A | 8/1982 | Chou |
| 5,050,086 | A | 9/1991 | Lambregts |
| 5,179,525 | A | 1/1993 | Griffis et al. |
| 5,417,615 | A | 5/1995 | Beard |
| 5,431,569 | A | 7/1995 | Simpkins et al. |
| 5,584,697 | A | 12/1996 | Trumbull |
| 5,656,905 | A | 8/1997 | Tsai |
| 5,752,008 | A | 5/1998 | Bowling |
| 5,752,834 | A | 5/1998 | Ling |
| 5,791,903 | A | 8/1998 | Feuer et al. |
| 5,827,065 | A | 10/1998 | Mcclintic |
| 5,880,956 | A | 3/1999 | Graf |
| 5,964,666 | A | 10/1999 | Uemura |
| 6,027,342 | A | 2/2000 | Brown |
| 6,431,872 | B1 | 8/2002 | Shiraishi et al. |
| 6,431,989 | B1 | 8/2002 | Katayama et al. |
| 6,435,995 | B1 | 8/2002 | Salgo |
| 6,445,960 | B1 | 9/2002 | Borta |
| 6,629,895 | B2 | 10/2003 | Uemura et al. |
| 6,634,885 | B2 * | 10/2003 | Hodgetts ..... G09B 9/12 434/29 |
| 6,733,293 | B2 | 5/2004 | Baker et al. |
| 7,484,460 | B2 | 2/2009 | Blum et al. |
| 7,806,697 | B2 | 10/2010 | Mallaci et al. |
| 7,922,594 | B2 | 4/2011 | Verl et al. |
| 7,967,688 | B2 | 6/2011 | Lai et al. |
| 8,201,467 | B2 | 6/2012 | Johnson et al. |
| 8,395,335 | B2 | 3/2013 | Marchand et al. |
| 8,444,496 | B2 | 5/2013 | Lai et al. |
| 2001/0029011 | A1 | 10/2001 | Dagani et al. |
| 2002/0116078 | A1 | 8/2002 | Lee et al. |
| 2003/0224333 | A1 | 12/2003 | Vastvedt |
| 2004/0160415 | A1 | 8/2004 | Rosenberg et al. |
| 2004/0181380 | A1 | 9/2004 | Yoshida et al. |
| 2007/0134637 | A1 | 6/2007 | Bronstein et al. |
| 2007/0218427 | A1 | 9/2007 | Lefton |
| 2007/0269771 | A1 | 11/2007 | Lefton |
| 2007/0299642 | A1 | 12/2007 | Kondo |
| 2008/0286726 | A1 | 11/2008 | Bennett |
| 2011/0070564 | A2 | 2/2009 | Van |
| 2009/0163283 | A1 | 6/2009 | Childress |
| 2010/0032543 | A1 | 2/2010 | Van Der et al. |
| 2010/0070248 | A1 | 3/2010 | Morali et al. |
| 2010/0092267 | A1 | 4/2010 | Najdovski et al. |
| 2010/0100365 | A1 | 4/2010 | Moriyama |
| 2010/0131865 | A1 | 5/2010 | Ackley et al. |
| 2010/0228396 | A1 | 9/2010 | Pechev |
| 2010/0279255 | A1 | 11/2010 | Williams |
| 2010/0302258 | A1 | 12/2010 | Epps et al. |
| 2011/0087474 | A1 | 4/2011 | Paulsen et al. |
| 2011/0093250 | A1 | 4/2011 | Lin |
| 2011/0177873 | A1 | 7/2011 | Sebelia et al. |
| 2012/0029703 | A1 | 2/2012 | Veltena |
| 2013/0018374 | A1 | 1/2013 | Edelhauser et al. |
| 2013/0045812 | A1 | 2/2013 | Garner |

* cited by examiner

AMUSEMENT PARK ELEVATOR DROP RIDE SYSTEM AND ASSOCIATED METHODS

CROSS-REFERENCE TO RELATED APPLICATIONS

This application is a continuation of U.S. Utility application Ser. No. 14/156,975 filed Jan. 16, 2014 which itself claims the benefit of U.S. Provisional Patent Application Ser. No. 61/753,013 filed Jan. 16, 2013 for Amusement Park Elevator Drop Ride System and Associated Methods, and is a Continuation-In-Part Application of U.S. Utility application Ser. No. 14/094,883 filed Dec. 3, 2013 for Motion Simulation System and Associated Methods, which itself claims priority to U.S. Provisional Application Ser. No. 61/732,534 filed Dec. 3, 2012, the disclosures of which are hereby incorporated by reference in their entirety and all commonly owned.

FIELD OF THE INVENTION

The present invention generally relates to motion simulation such as in amusement rides including gravity drops, and in particular relates to an elevator system with a motion system with at least one degree of freedom in a vertical (heave) direction.

BACKGROUND

Vertical elevators and vertical ride systems have played an important role in the development of amusement rides over many years and at least from early 1990. The systems have typically been powered electrically with cable drives, or by pneumatic systems.

By way of example, one amusement ride referred to as Tower of Terror includes a simulated elevator drop ride that opened on Jul. 22, 1994 at Walt Disney World® in Florida. The attraction at Disney's Hollywood Studios simulated a system of The Twilight Zone Tower of Terror and employs specialized technology including the ability to move a vehicle in and out of a vertical motion shaft. Elevator cabs are self-propelled automated ride vehicles which lock into separate vertical motion cabs that can move into and out of elevators horizontally, move through a scene and on to a drop shaft.

In order to achieve a weightless effect, cables attached to the bottom of the elevator car pull it down at acceleration slightly greater than what a free-fall in gravity would provide. Two relatively large ("enormous") motors are located at the top of the tower. The motors are 12 feet (3.7 m) tall, 35 feet (11 m) long, and weigh 132,000 pounds. They are able to accelerate 10 tons at 15 times the speed of normal elevators. They generate torque equal to that of 275 Corvette engines and reach top speeds in 1.5 seconds.

For a drop sequence, the elevator starts its drop sequence, but rather than a simple gravity-powered drop, the elevator is pulled downwards with an acceleration exceeding 1 g, causing riders to rise off their seats, held down only by a seat belt or by a lapbar. A random pattern of drops and lifts have been added, where the ride vehicle will drop or rise various distances at different intervals. When guests enter the drop shaft, a computer randomly chooses a drop profile. Each drop sequence features a faux drop meant to startle the riders, and one complete drop through the entire tower. After a series of these drops have been made, the elevator returns to a basement of a decrepit hotel scene.

Typically, for operators of other tower ride systems, control has been relatively imprecise and finessing a desirable motion through refinement and delicacy of performance and execution has not met expectations. By way of example, one of the attributes that owners of such systems would like to have is the ability to drop with acceleration greater than gravitational acceleration (i.e. greater than acceleration due to gravity, 1 g or 9.81 $m/s^2$). To be able to achieve greater than gravitational acceleration currently requires a closed loop drive system which significantly increases the complexity, the power requirements, the initial costs and the costs of operation and maintenance. For example, increasing from an acceleration of 8.5 $m/s^2$ with an open loop system to 9.81 $m/s^2$ with a closed loop system, results in roughly doubling the size of a drive system (motor and gearboxes) and requires an increase in cable mass of around 45%. In the open loop system, the cabin or platform drops under gravity, but is limited to an acceleration of around 8.5 $m/s^2$ due to frictional resistance (air resistance and mechanical friction) in the system. The maximum downward acceleration that is permitted with a lap bar or seat belt restraint system required by typical amusement rides is 1.2 g. Therefore, it is desirable to develop an amusement system or apparatus that is capable of dropping with an acceleration of up to 1.2 g, but at a desirable cost and with a desirable lifetime for the cables which form part of the elevator drive system.

To date, only the above described Walt Disney World® elevator drop ride has been able to develop such a closed loop drive system. Due to the size and the cost of the drive system and the ownership costs of operating and maintaining a closed loop drive system, no other amusement parks have developed such an elevator system with higher than gravitational acceleration as it has been economically unviable.

There is a need for enabling acceleration in excess of gravitational acceleration in a cost effective manner. There is further a need for enabling complex heave motion (up and down motion) without negatively impacting life of elevator systems using closed loop drive cables. Yet further, a superposition of complex vibrational modes up to at least 100 Hz is desirable.

SUMMARY

Embodiments of the present invention provide motion systems with at least one degree of freedom in the vertical direction, known as "heave", together with an open loop elevator cable drive system. One embodiment provides an elevator with an open loop cable drive system that drops under gravitational acceleration, less any frictional resistance in the system, with typical maximum drop acceleration in a region of 8.5 $m/s^2$, representing frictional and other losses of around 13.4%.

One embodiment may be described as an elevator dropping motion simulation system comprising an elevator platform and a plurality of actuators carried by the elevator platform. Each of the plurality of actuators may include a support plate configured to connect with the elevator platform, a planetary gearbox engaged with and driven by at least one electric servo motor, and a drive shaft driven by the servo motor and engaged with at least one crank. A plurality of connecting rods is each engaged at a proximal end with one crank of a corresponding one actuator. A frame is attached to the passenger platform, wherein a distal end of each connecting rod is engaged with the frame. A control system is operable with each electric servo motor of each actuator for operational control thereof and for providing a simulated motion including at least one of heave to the frame and thus to the passenger platform.

One embodiment of the invention may comprise a motion system where the heave motion is designed so that during the drop of a free fall drop of an elevator the additional downward acceleration is in the range of 1.3 $m/s^2$ to 3.3 $m/s^2$ to provide a total vertical downward acceleration of 9.8 $m/s^2$ to 11.8 $m/s^2$ (i.e. 1.0 g to 1.2 g). While higher accelerations may be possible, such are not currently permitted under rules governing accelerations permitted with lap bar or seat belt restraint systems. However higher accelerations would be permitted with an "over-the-shoulder" harness system, wherein such restraint systems are used on roller coasters that go through inversions (i.e. go upside down), by way of example with acceleration of typically up to 3 g.

Embodiments of the invention enable accelerations in excess of gravitational acceleration (i.e. >1 g) in cost effective ways that are not possible to date. A complex heave motion (up and down motion) is provided without impacting (reducing) the life of elevator system drive cables. Superposition of complex vibrational modes up to at least 100 Hz is achieved. In addition, other motions are possible through the use of the motion systems such as roll or pitch with a 2-axis motion system, roll and/or pitch with a 3-axis motion systems and roll, pitch, surge, sway and/or yaw with a 6-axis motion system, by way of examples. Thus, embodiments of the invention may be used in amusement rides herein described by way of example, and in professional simulation and training systems. It would not be possible for known closed loop systems developed and operated to date to include complex vibrations up to at least 100 Hz without the use of a secondary vibration system fitted between the elevator frame and the cabin, or integrated into the cabin which would add further cost and complexity.

BRIEF DESCRIPTION OF DRAWINGS

Embodiments of the invention are described by way of example with reference to the accompanying drawings in which.

DETAILED DESCRIPTION OF EMBODIMENTS

Embodiments of the invention will now be described more fully hereinafter with reference to the accompanying drawings, in which the embodiments are shown by way of illustration and example. It is to be understood that the invention may be embodied in many forms and should not be construed as limited to the embodiments set forth herein. Rather, these embodiments are provided so that this disclosure will be thorough and complete, and will fully convey the scope of the invention to those skilled in the art.

Figure 1:
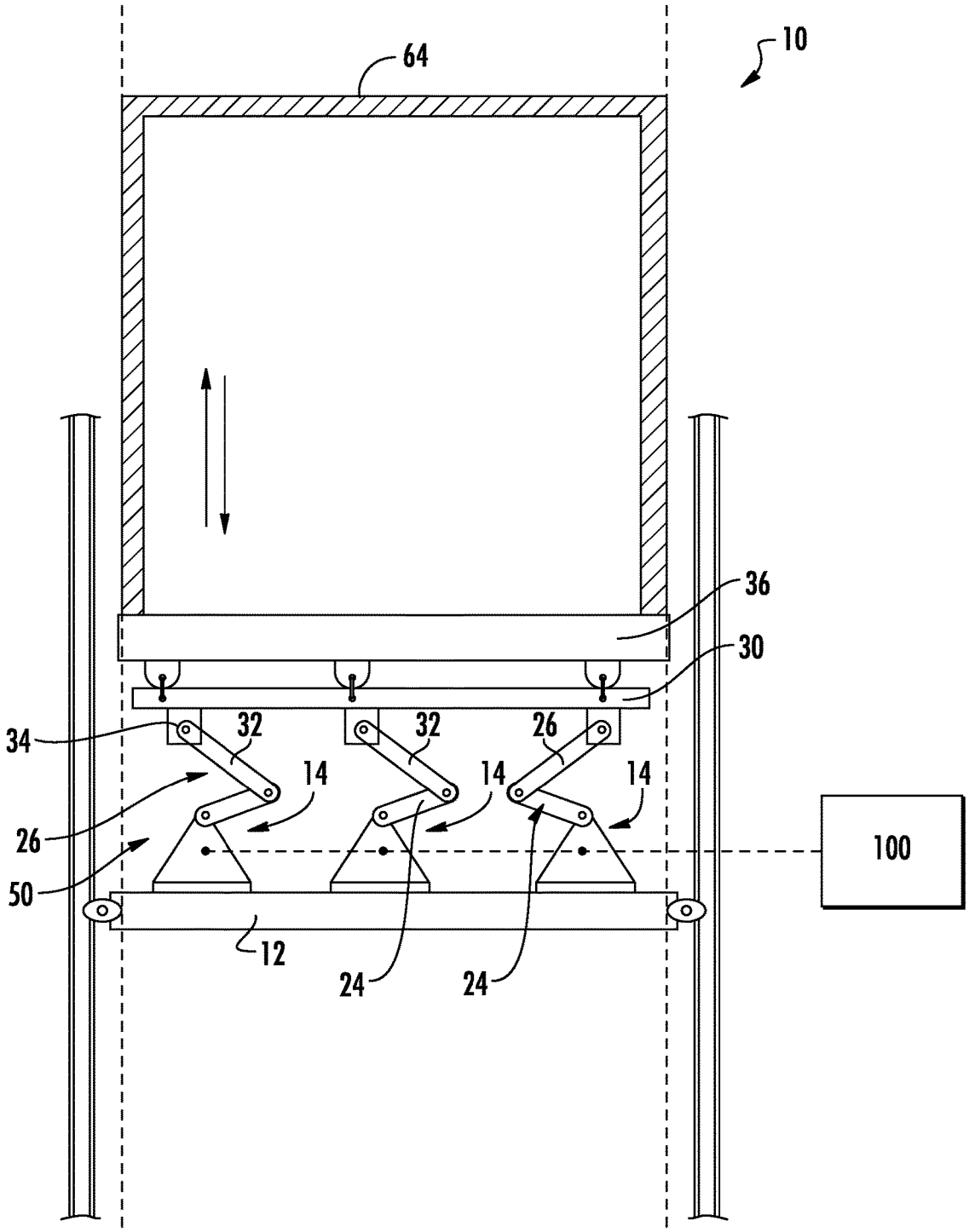
FIG. 1 is a diagrammatical illustration of an elevator system including a passenger platform operable for having an enhanced dropping effect according to the teachings of the present invention.
Figure 2:
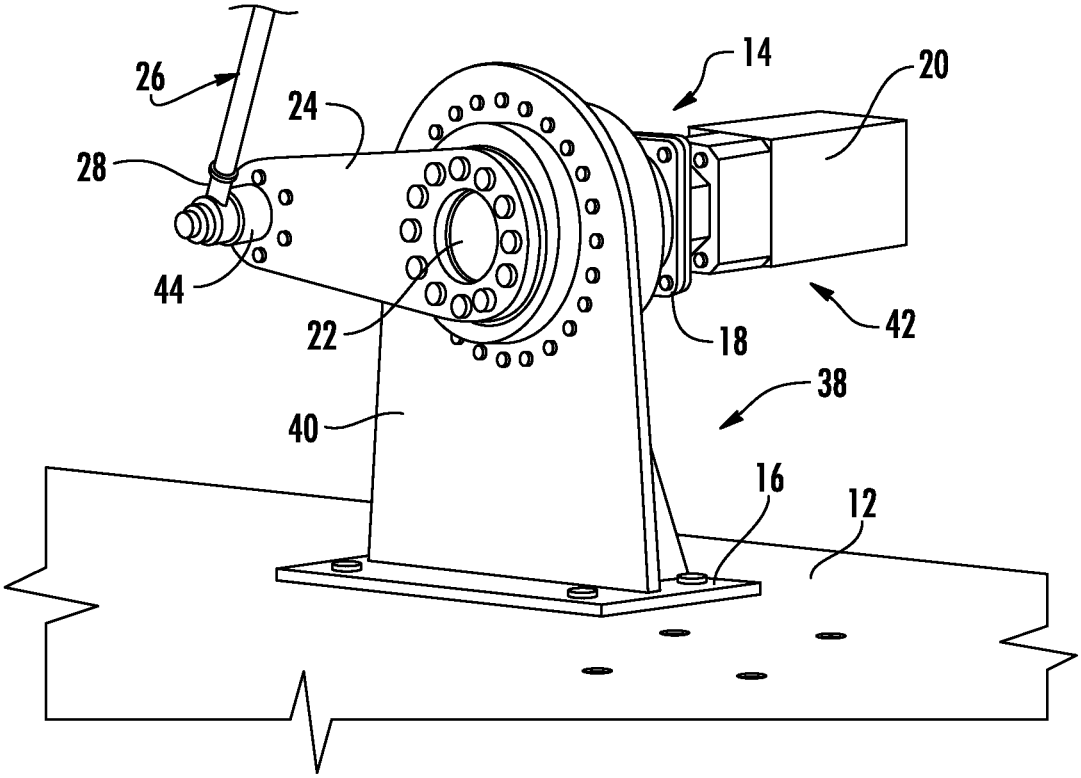
FIG. 2 is a perspective view of an actuator used with various motion systems according to the teachings of the present invention.

With reference initially to FIG. 1, one embodiment of the invention is herein described as an elevator system 10 comprising an elevator platform 12 and a plurality of actuators 14 carried by the elevator platform. As illustrated with reference to FIG. 2, and as described in U.S. patent application Ser. No. 14/094,883 filed on Dec. 3, 2013 for Motion Simulation System and Associated Methods, the disclosure of which is herein incorporated by reference in its entirety, each actuator 14 includes a support plate 16, herein configured to be connect with the elevator platform 12. Further, each actuator 14 includes a planetary gearbox 18 engaged with and driven by at least one electric servo motor 20, and a drive shaft 22 driven by the servo motor and engaged with a crank. A connecting rod 26 has its proximal end 28 engaged with the crank 24.

Figure 5:
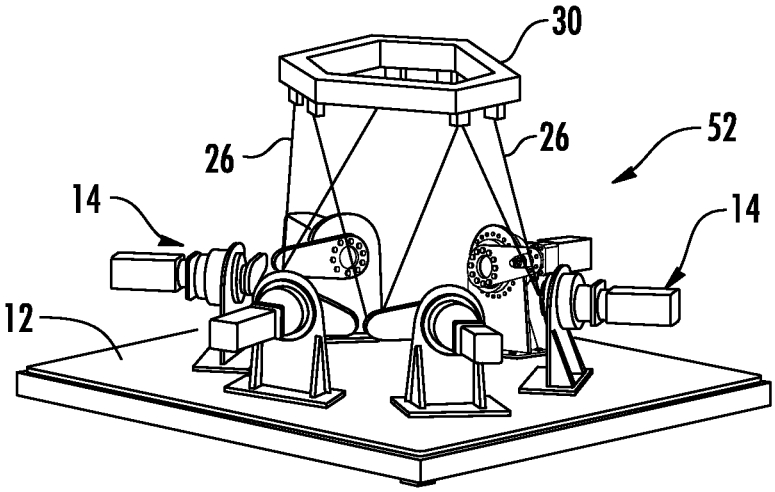
FIG. 5 is a perspective view of a six degree of freedom, six-axis motion system, according to the teachings of the present invention, optionally operable with an elevator drop amusement ride, by way of example.
Figure 3:
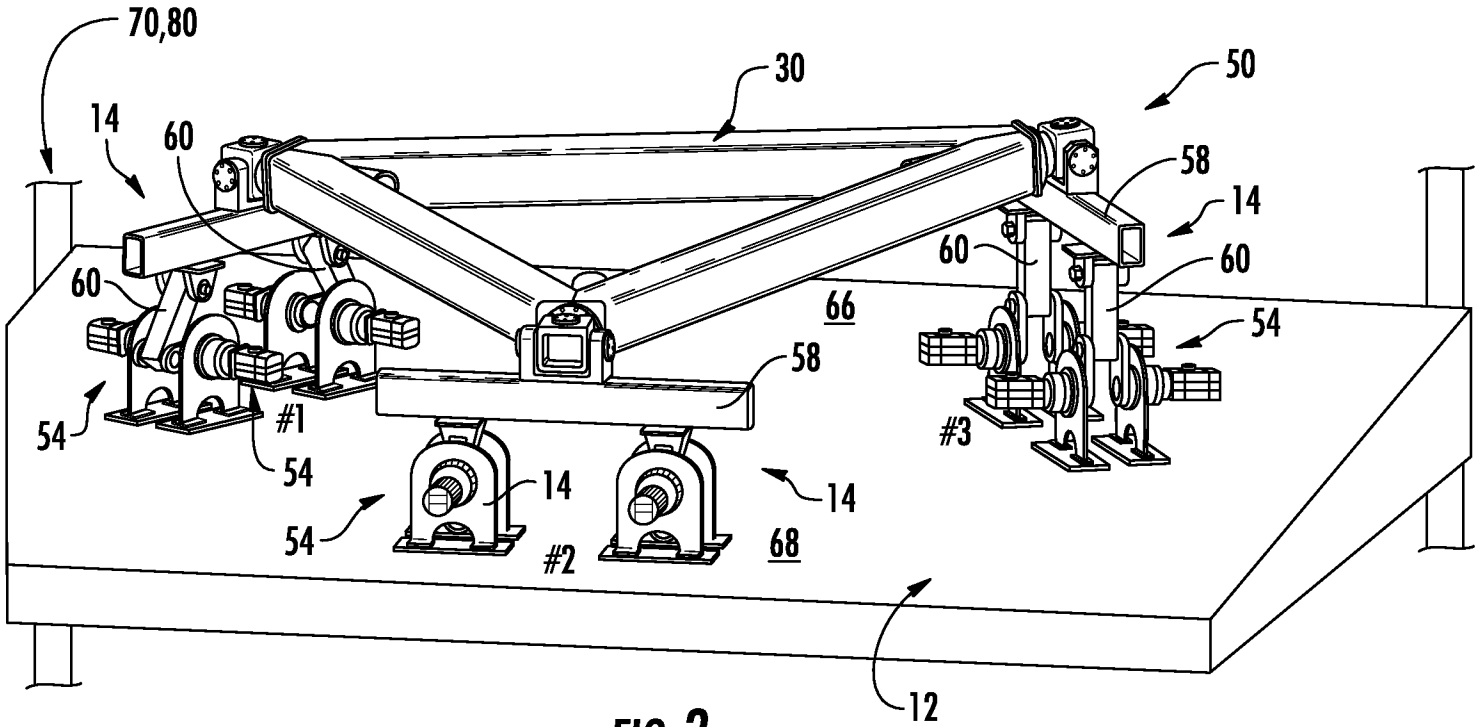
FIGS. 3 and 4 are perspective views illustrating three-axis motion systems according to the teachings of the present invention, operable with an elevator drop amusement ride, by way of example.
Figure 4:
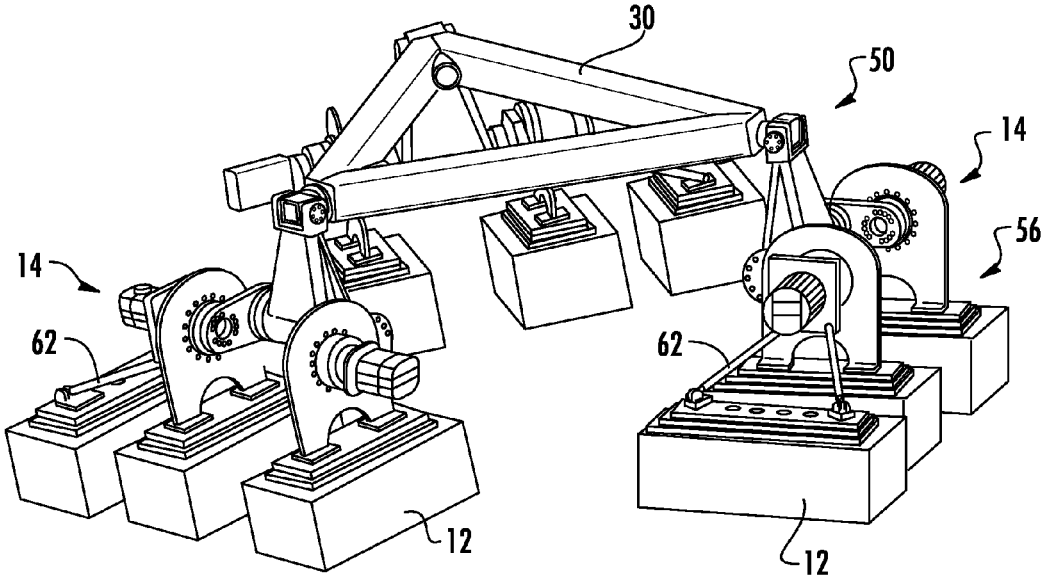

In one embodiment, and as illustrated with reference to FIGS. 3, 4 and 5, the system may be provided with a variety of axis combinations from one to six axis systems, by way of example. The system 10 includes a plurality of actuators 14, with each actuator mounted on the platform 12, as earlier described with reference to FIG. 1. As illustrated with reference again to FIGS. 2 and 5, each actuator 14 (herein a single motor/gearbox actuator assembly) is connected to a section of a frame 30. As illustrated with reference again to FIG. 1, distal ends 32 of the connecting rods 26 are pivotally attached to the frame 30 using upper bearings 34. The frame 30 is configured to be connected to a passenger platform 36.

With reference again to FIG. 2, each actuator 14 includes a main actuator support 38 having the support plate 16 connected to the elevator platform 12 and a vertical stand 40 rising from the support plate 16 to receive a motor/gearbox assembly 42 including the gearbox 18 and motor 20. The motor/gearbox assembly 42 includes the electric servomotor 20 connected to the planetary gearbox 18 which motor/gearbox assembly is engaged with the drive shaft 22 driven by the motor. The motor, the gearbox and the drive shaft are provided as a single unit referred to the "motor/gearbox assembly" but can be provided as separate components without departing from the teachings of the present invention. The motor is an electrical servo motor that is controlled by a control system as will later be described.

The motor/gearbox assembly 42 is connected to the crank 24 which is a rigid elongate member having a face connected perpendicularly to the plane of a longitudinal axis of the drive shaft 22. The crank 24 receives a lower spherical bearing 44 for connection to the connecting rod 26, or equivalent.

The elevator system 10 can employ a single axis, or multi-axis motion system 50 including by way of example only, one, two, three and six axes. By way of example, three axis motion systems 50 are illustrated with reference again to FIGS. 3 and 4, and a six axis motion system 52 illustrated with reference again to FIG. 5. The motion systems 50, 52 components can be varied to provide for desired and different configurations. For example, the number, size and positioning of components can be varied such as varying the number of cranks, connector rods and frame sections. The electric motors and planetary gear boxes can be provided according to the number of axes, or some multiple of the number of axes. By way of example, the motion system can be provided with two motors and two gearboxes per actuator or even up to four motors and four gearboxes per actuator, as desired to accommodate payload, and as illustrated with reference again to FIG. 3.

As illustrated with reference to FIG. 3, the embodiment herein described includes the actuator 14 including a quad motor/gearbox assembly 54 operable with cranks 24 connected to a common connecting rod 26. Yet further, an actuator may include a dual motor/gearbox assembly 56, as illustrated with reference again to FIG. 4. Such actuators are useful with the 3 DOF motion systems 50 illustrated with reference to FIGS. 3 and 4, by way of example. With continued reference to FIG. 3, the actuator 14 includes a beam 58 to which arm members 60 are pivotally connected at their distal ends to the beam and at their proximal ends to the cranks 24 at distal ends thereof. Two cranks 24 are paired to be connected to the arm member 60. Yet further, two dual motor/gearbox assemblies 56 are themselves paired to form a quad actuator 14Q. Thus, four motors and four gearboxes drive the single quad actuator. One connecting rod is provided per actuator with two spherical bearings per rod, one bearing at each end of the connecting rod as above disclosed. Such a motion system 50 is used in the elevator system 10 of FIG. 1, illustrated by way of example As illustrated with reference again to FIG. 4, the motion system 50 may be used as an actuator having a quad gearbox assembly for an actuator having a six motor/gearbox assembly, which is desirable for relatively heavy payloads typical in amusement rides. The beam may be configured as a triangular beam and three dual motor/gearbox assemblies are operably and pivotally connected to the triangular beam. Actuator supports 62 may be anchored to the elevator platform 12 for providing increased stability to the actuator, as illustrated with reference to FIG. 4.

With reference again to FIG. 1, the frame 30 is attached to the passenger platform 36, wherein the connecting rods 26 are engaged with the frame. As will come to the mind of those skilled in the art, the actuators 14 may be attached directly to the passenger platform 36 without deviating from the teachings of the present invention. Further, the passenger platform 36 may be formed as or part of an enclosed or partially enclosed elevator cabin 64.

With reference again to FIG. 1, a control system 100 as described in U.S. patent application Ser. No. 14/094,883 is operable with each electric servo motor 20 of each actuator 14 for operational control thereof and for providing a simulated motion including, by way of example, a heaving motion to the frame 30 and thus to the passenger platform 36, wherein the control system uses a motion controller and servo drives to generate and control complex motion profiles, as desired for the simulation being executed.

Motion simulation to the elevator may be provided by various embodiments providing a single and multiple degrees of freedom. As above described, three degree of freedom assemblies are provided for the embodiments illustrated with reference to FIGS. 3 and 4, by way of example. As described for accommodating payload and ride constraints, each actuator 14 may comprise a single drive motor and gearbox, a double motor and gearbox or an actuator pair such that each part of the actuator pair has either a single or a double motor and gearbox arrangement.

Further, and as illustrated with reference to FIG. 5, the elevator system 10 may comprise a six-axis motion system 52 for providing a variety of motions as may be desirable to create special effects on riders of the elevator.

Figure 6:
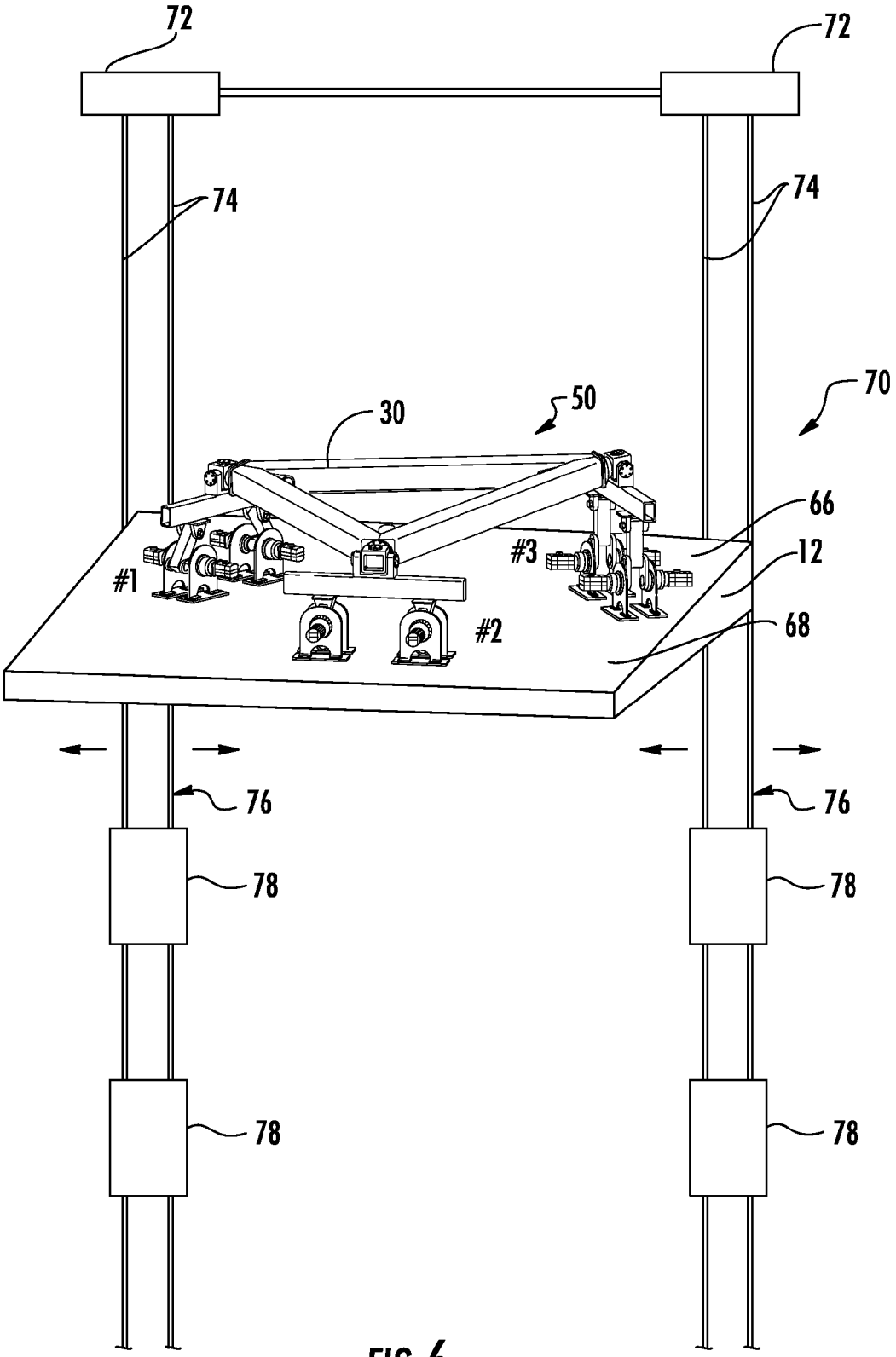
FIGS. 6 and 7 are partial diagrammatical illustrations of a three axis motion system operable with open loop and closed loop elevator cable systems, respectively.
Figure 7:
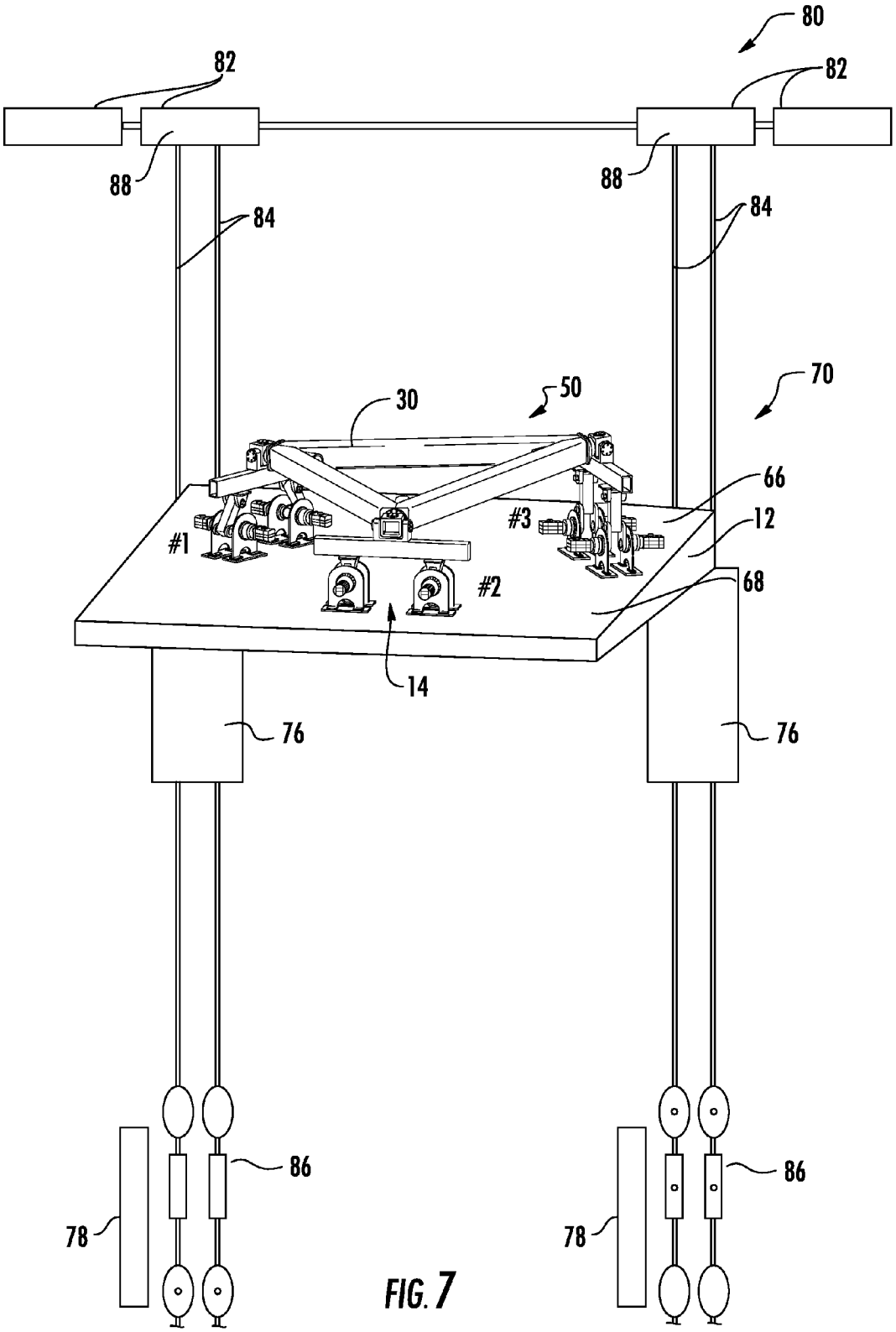

Yet further, and as illustrated with reference to FIGS. 6 and 7, the elevator systems including motion system embodiments of the invention may be integrated with existing elevator systems and include typical devices such as brakes, of both frictional and/or magnetic types, and auxiliary components, or auxiliary cabling assemblies communicating with the control system. FIGS. 6 and 7 are partial diagrammatical illustrations of a three axis motion system operable with open loop and closed loop elevator cable systems, respectively.

As illustrated with reference again to FIG. 3, it may be desirable to have two actuators (#1, #3) at a rear portion 66 of the elevator platform 12 and another actuator (#2) located at a front portion 68 depending upon anticipated weight distribution. Alternatively, the actuators 14 may be located to account for a known load distribution as desired. By way of example, locations of the actuators 14 can also be reversed when compared to the embodiment of FIG. 3, with one at the rear and two at the front. The choice will typically depend on mass distribution, center of mass and moments of inertia. For example, the Flyboard described in the above cited patent application has the actuators with one at its back platform portion and two at the front because the front row of the amusement ride has more people than the back row and hence such an arrangement of actuators provides a desirable configuration for the mass, center of mass and moments of inertia. Further, such an arrangement of the actuators allows a projector on the Flyboard configuration to be located under the platform between the two front actuators and thus efficiently utilizes space in the theatre which has a resulting cost benefit. Yet further, the rear actuator may be of a differing size/capacity compared to the front actuators if necessary to provide a more even balance with the variable possible distributions of mass, center of mass and moments of inertia and thus a better balance between the static and dynamic loads between the actuators.

As above described, the motion system 50 illustrated with reference again to FIG. 3 may be employed with an elevator drive system 70 such as in an open loop or closed loop system illustrated in FIGS. 6 and 7, wherein the passenger platform assembly illustrated in FIG. 1 and the enclosed elevator cart/cabin is not shown for clarity. As understood by those of skill in the art, the elevator platform 12 is typically a rigid assembly which supports the motion system 50, the passenger platform 36 and the enclosed elevator cabin 64. As above described, the passenger platform 36 is mounted to the frame 30 of the motion system 50. The enclosed elevator cart/cabin 64 is mounted to the passenger platform 36, wherein the mounting arrangement may be permanent or temporary, as in well-known elevator drop rides to enable the enclosed elevator cabin to move onto and off the passenger platform. In the case of the temporary arrangement, fixing the system would include locks and sensors to ensure the cabin 64 is in position and locked before any movement of the elevator is permitted. Similarly, at the end of a ride cycle, the passenger platform 36 is aligned and locked before the cabin 64 is unlocked to enable the transfer of the passenger platform. The elevator platform 12 may be either cantilevered from a cable drive system, or it may be supported by cable drives at or close to its four corners, by way of example.

By way of example, and with reference to FIG. 6, the elevator platform 12 and the motion system 50 may be integrated into an open loop cable drive elevator system 70, which has been found to reduce typical costs and complexity. A DC motor and cable drum assembly 72 drive a cable 74 operable with the elevator platform 12 using a balanced beam, by way of non-limiting example. A braking system 76 operable with the platform 12 comprises movable brakes 78, which may include friction brakes or magnetic eddy current brakes, by way of example. Emergency brakes 78 are also employed as part of the elevator system.

One embodiment of the elevator system 10 includes the elevator platform 12 and the motion system 50 integrated into a closed loop cable drive elevator system 80, by way of further example. The system comprises two relatively very large motors 82, and optionally four motors, and large relative to those of the open loop system of FIG. 6, by way of example as in the above described system employed at Disney's Hollywood Studios for the simulation system of The Twilight Zone Tower of Terror. The cable 84 in such a closed loop system 80 requires sheaves and tensioning devices 86. As the system is closed loop, the cable scheme is doubled on both sides as the cable has to return up to motor and drum drive drum 88. Typically with the closed loop system 80, twelve sheaves (six per side) and four cable tensioning devices 86 (two per side) are required. While typically more complex and demanding, the closed loop system 80 is compatible with embodiments of the invention.

By way of example in achieving a complex heave motion such as a desired up and down motion of an elevator without adversely affecting the life of elevator system drive cables, one control system is such that the drop of the motion system 50 is accurately synchronized with the elevator drive system 70, 80.

The control system is operable with each electric servo motor of each actuator for operational control thereof and for providing a simulated motion in at least one vertical axis to the frame and thus to the passenger platform. The control system includes a washout filter module for transforming input forces and rotational movements with forces that are below the level or human perception. Further, the control system provides high data update rates coupled with advanced real time, and dynamically responsive motion control algorithms for providing desirably smooth and accurate simulator for enabling absolute synchronization with the cable drive system.

By way of example, the control system 100 may be operable with optionally, one, two, three or six degree of freedom motion systems that may enable full 360 degree rotations of the actuators for utilizing a full heave stroke of the actuators. The motion systems can directly superimpose vibrations of up to at least 100 Hz. One embodiment of the control system includes a washout filter module used to transform input forces and rotations of the platform into positions and rotations of the motion platform with forces that are below the level or human perception. This washout filter is an implementation of a classical washout filter algorithm with improvements including a forward speed based input signal shaping, extra injected position and rotation, extra injected cabin roll/pitch (for a 3-axis system) and roll/pitch/yaw/surge/sway (for a 6-axis system) by way of examples), and rotation center offset from the motion platform center when in the neutral position. The washout filter has two main streams including high frequency accelerations and rotations (short term and washed out), and low frequency accelerations (a gravity vector) and is more fully described in U.S. patent application Ser. No. 14/094,883.

As above described with reference to FIG. 1, the control system 100 is programmed to send signals to the electric motors 20 to drive the actuators 14 to and through desired positions. For example, the control system 100 may send signals to vary the speed of the electric motors and to move the actuator elements into a desired position by moving the crank through a path of rotation and the connector rod through one or more paths in and across multiple axis of rotation.

As above illustrated, embodiments may utilize a single axis, or multi-axis systems including by way of example, one, two, three and six axes. Four and five axes of motion can be achieved by constraining the motion of the relevant axes in a 6-axis motion system. The motion system components can be varied to provide different configurations or to provide different applications with the same axis structure. The number, size and positioning of components can be varied such as varying the number of crank arms and connecting rods and planes which they rotate and work. Electric motors and planetary gear boxes may be provided according to the number of axes, or some multiple of the number of axes. As above illustrated with reference to FIGS. 3 and 4, embodiments may be provided with two motors and two gearboxes per actuator or even up to four motors and gearboxes per actuator. Connecting rods typically are provided one per actuator with two spherical bearings per actuator, one bearing at each end of the connecting rod. The actuators move in synchronized manner to create motion in a desired direction for providing a heaving effect, by way of example. One feature to further enhance the above described system includes the motion system actuators rotatable through 360° (thus movable through a complete circle). This is achieved with the three (3) degree of freedom system and allows more of the vertical motion to be utilized as the motion system actuators do not need to decelerate at the ends of their stroke (unlike a ball-screw, or hydraulic motion systems). Embodiments may therefore comprise the control system operable with one, two, three or six degree of freedom motion systems that enable full 360 degree rotations of the actuators for utilizing a full heave stroke of the actuators.

By way of example, the components above described, such as the actuators, work through all levels of axis systems including 1-axis, 2-axis, 3-axis and 6-axis systems. The frame of the motion systems provides for variable configurations which can be used for different simulator applications. For example, in a flight simulator, the cranks 40 and the connector rods 58 can be adjusted to configure the system 10 for different aircraft types. The flexibility of configuration is enabled by changing the cranks 40 and/or the connector rods 58 by having adjustable cranks and connector rods, or may easily be replaced with cranks and/or connector rods of different lengths or geometries. This flexibility is provided by the ability of the control system to be programmed for different configurations and to control the movement of the actuators and platform. Such a variable system has not been accomplished to date. Embodiments of the present invention provide improvements over known systems which are geometrically fixed and cannot be adapted to suit varying geometric configurations.

The compactness of the motion systems, herein presented by way of example, enables components of the system to be desirably packaged on a single base as herein described for an amusement ride employing the three axis motion system 50. The more demanding flight simulation systems can effectively use the six axis system 52. The load carrying capability of the systems herein described by way of example goes beyond what is currently possible with known electrical motion systems, and goes beyond the largest known hydraulic system. The performance of the systems herein described goes beyond what is possible with current leading edge electrical systems which are of the ball-screw type limited in fidelity by the mechanical configuration.

By way of example with reference again to the 3 DOF system, each pair of motors is synchronized in a position mode. Typical systems were configured with one motor controlled by position and the second motor controlled through torque matching (or current following). As a result of the teachings of the present invention, embodiments of the present invention provide an absolute positioning of the synchronized motors. By way of contrast, typical torque matching techniques (or current following methods) do not take into account variations in production within and between the motor/gearbox assemblies. The motors can be controlled to synchronize their position on an absolute position of rotation. For example, if motor pairs are used, the two motors can be controlled to adjust one motor to match the position of the other motor. With reference again to the embodiments of FIGS. 3 and 4, by way of example, each actuator 14 has the motors 20 in a motor pair running in opposite directions. This applies to any multi axis system using dual motor/gearbox assemblies Synchronization is achieved via multiple virtual axes and electronic gearing, with an internal correction. This enables the nesting of effects described above.

The ability to synchronize the motor pairs within the actuator 14 allows for the systems 50 to handle higher payloads. Payloads of at least 20 tonnes for six axis systems employing a single motor per actuator, and at least one and one half times this payload when employing motor pairs, are achievable. It should be noted that while each actuator can run with one pair or two pairs of motor/gearbox assemblies, systems can also operate with a single motor/gearbox assembly. The number and configuration of the motor/gearbox assemblies is primarily determined by the load and acceleration requirements.

The embodiments of the systems herein described operate with reduced power consumption as it can operate as a regenerative power system. This is enabled by the use of servos connected to a common DC Bus which is fed via the DC Regenerative Power Supplies and reactors. The regenerative power works by using decelerating drives feeding power to accelerating drives, hence reducing overall power intake. The system regenerates power throughout the whole ride cycle whenever a drive is in a decelerating mode, regardless of whether it is going up or down. This new teaching minimizes the overall power consumption. During motion where net deceleration is greater than net accelerations plus losses, energy may be shared with other actuators cooperating therewith, or stored locally in a capacitor arrangement or returned to the grid (utility supply) at the correct phase, voltage and frequency. This approach has eliminated the need for breaking resistors and all excess energy can be returned to the grid (utility supply). This results in the minimal use of power. Power consumption has been found to be less than one half the power consumption of a traditional ball-screw system with a counterbalance which may be pneumatic, less than ⅓ of the power consumption of the ball-screw system without a counter balance system, and less than 15% of the power of an equivalent hydraulic system, thus about an 85% power savings when compared to an equivalent hydraulic system.

Improvements and benefits over existing traditional hexapod electric ball-screw motion systems include the configuration of the cam mechanism, especially when coupled with high end servo-motors, drives and planetary gearboxes, results in zero mechanical backlash as planet gears remain in contact with the output shaft teeth throughout the full range of motion. By way of example, the system can be readily configured to a different configuration within a few hours by replacing cranks and connector rods with those of differing lengths to suit various aircraft platforms (within physical constraints). This will also allow the same motors and gearboxes to provide a greater range of excursions when coupled to a smaller cabin of a flight simulator. The classic Hexapod system has no such configuration flexibility and a separate motion system is required for each platform type. The configuration is not constrained to current load carrying and acceleration performance of the existing Hexapod systems.

A 24 tonne payload 3-axis motion system is currently being developed according to the teachings of the present invention for the leisure industry. A 9 tonne payload 3-axis motion system and a 2 tonne 6-axis motion system are currently being tested.

A user friendly suite of software tools enables program parameters to be changed without the need for a specialist programmer to make changes at source code level. A desirable motor synchronization is provided when double motors or quad motors are required to meet payload load and performance specifications. Synchronization is achieved through the use of virtual axes, electronic gearing and real time internal correction loops running at 1 millisecond intervals, by way of example.

Full regenerative energy capability can be included so that any decelerating actuator works in a fully regenerative mode. This provides typical powers which are in the region of one-third of a non-counterbalanced ball-screw system and one-half of a pneumatically counterbalanced ball-screw system. The reduction in thermal loading significantly extends the life of all electrical and electronic components minimizing maintenance costs and maximizing availability. The system also has the optional ability to return excess power to the utility grid when internal regeneration exceeds system needs. This is not possible with hydraulic and ball-screw type drive systems.

The system uses an industrialized sophisticated motion controller and high quality servo drives to generate and control complex motion profiles. The motion controller receives data from the Motion PC via User Datagram Protocol (UDP). After processing, the data is sent to the servo drives using a 1 msec Loop Closure (Data Send and Receive rate) while the internal drive loop closure is within the nano-second range. High Data update rates coupled with advanced "Real Time, Dynamically Responsive" motion control algorithms allows the creation of desirably smooth and accurate simulator motion beyond that provided by known motion simulator systems.

Motion effect algorithms allow complex vibrations to be superimposed onto the motion (directly imparted through the drive system) up to the saturation level of the whole system. Vibrational frequencies exceeding 100 Hz are achieved. Resonant frequencies can easily be identified and avoided. In contrast, electric ball-screw and hydraulic systems have limited vibrational capabilities in the region of 30-35 Hz. In addition, a secondary vibration system has to be installed where higher frequencies are required.

One desirable characteristic of the motion systems herein presented includes mass and center of mass determinations during operation of the system. By way of example, when the system moves to the neutral position in the amusement industry applications, the system is able to measure the motor torques and currents of each motor. Through triangulation the mass and the center of mass of the system can be determined. This information may then be used so that, regardless of a variable guest mass and a distribution of the variable guest mass, a ride acceleration profile can be adjusted instantaneously so that the guests always experience and feel the same motion, and hence the same ride experience regardless of the guest mass and guest mass distribution. This mechanism may also be used in any type of simulator to ensure that the guest experience is identical regardless of the mass of the guest in each vehicle.

Furthermore, with the advantages in motion fidelity, vibrational characteristics of at least up to 100 Hz (and possibly beyond) can be superimposed through the motion system without any further devices.

Also by using an upward heave motion of the motion system, immediately prior to a drop, the illusion of higher acceleration during the drop is created as human guests sense the difference between relative motions (i.e. up then down).

Both the elevator system and the motion system may optionally include regenerative braking energy through recovering the energy used in braking to make the overall system very efficient.

Furthermore, complex heave (up and down) motion can be achieved through the motion system without using the main elevator cable drive system. This will maximize the life of the elevator drive system cables. Every reversal through the sheaves of the cable system reduces the service life due to cyclic induced loads. Elevator cable systems are very susceptible to fatigue through cyclic loading patterns.

The heave motion may also be complemented with motion from the additional degrees of freedom in the motion system such as pitch or roll in a 2-axis system, pitch and/or roll in a 3-axis system and pitch, roll, surge, sway and/or yaw in a 6-axis system, by way of examples. Such complimentary motions can provide desired motion effects in a drop elevator system which is not possible with a simple cable drive, whether such cable drive is open-loop or closed-loop.

As above described, the control system sends signals to the electric motor to drive the actuator to and through its desired positions. For example, the control system may send signals to vary the speed of the electric motors and to move the actuator elements into a desired position by moving the crank through a path of rotation and the connector rod through one or more paths in and across multiple axis of rotation. The actuators move in a synchronized manner to create motion in a desired direction for providing a heaving effect, by way of example. One feature to further enhance the above described system includes the motion system actuators rotatable through 360° (thus movable through a complete circle). This is achieved with the three (3) degree of freedom system as above described and allows more of the vertical motion to be utilized as the motion system actuators do not need to decelerate at the ends of their stroke (unlike a ball-screw, or hydraulic motion systems). Embodiments may therefore comprise the control system operable with one, two, three or six degree of freedom motion systems that enable full 360 degree rotations of the actuators for utilizing a full heave stroke of the actuators.

Furthermore, with the advantages in motion fidelity described in the above referenced pending patent application, vibrational characteristics of at least up to 100 Hz (and possibly beyond) can be superimposed through the motion system without any further devices.

Also by using an upward heave motion of the motion system, immediately prior to a drop, the illusion of higher acceleration during the drop is created as human guests sense the difference between relative motions (i.e. up then down).

Both the elevator system and the motion system may optionally include regenerative braking energy through recovering the energy used in braking to make the overall system very efficient.

Furthermore, complex heave (up and down) motion can be achieved through the motion system without using the main elevator cable drive system. This will maximize the life of the elevator drive system cables. Every reversal through the sheaves of the cable system reduces the service life due to cyclic induced loads. Elevator cable systems are very susceptible to fatigue through cyclic loading patterns.

Although the invention has been described relative to various selected embodiments herein presented by way of example, there are numerous variations and modifications that will be readily apparent to those skilled in the art in light of the above teachings. It is therefore to be understood that, within the scope of the claims hereto attached and supported by this specification, the invention may be practiced other than as specifically described.

That which is claimed is:

1. A method for moving a passenger platform in an elevator drop amusement ride, the method comprising:

fixing a plurality of actuators to an elevator platform, wherein each of the plurality of actuators includes at least one planetary gearbox engaged and driven by at least one electric servo motor, and a drive shaft driven by the servo motor for engaging at least one crank;

operably connecting each crank to the passenger platform; and controlling each electric servo motor of each actuator for simulating a vertical motion in the passenger platform;

providing a cable drive system operable with the elevator platform; and synchronizing movement provided by the controlling of each servo motor with movement provided by the cable drive system.

2. The method according to claim 1, wherein the connecting of the crank to the passenger platform comprises:

providing a frame;

attaching the frame to the passenger platform;

pivotally attaching a connecting rod between each crank and the frame sufficient for supporting the simulated motion.

3. The method according to claim 1, further comprising providing at least a partially enclosed cabin operable with the passenger platform.

4. The method according to claim 1, further comprising transforming input forces and rotational movements to the passenger platform with forces including high frequency accelerations and rotations over a short term and washed out, and low frequency accelerations addressing a gravity vector.

5. The method according to claim 1, wherein the fixing of the plurality of actuators comprises fixing at least one of a one, two, three and six degree of freedom motion system that enables full 360 degree rotations of the actuators for utilizing a full heave stroke thereof.

6. The method according to claim 1, wherein the fixing of the plurality of actuators comprises providing at least one of one, two and four motor/gearbox assemblies for each actuator.

7. The method according to claim 1, comprising moving the elevator platform and superimposing vibrations of up to at least 100 Hz thereto.

* * * * *